US011414222B2

(12) United States Patent
De Luca

(10) Patent No.: US 11,414,222 B2
(45) Date of Patent: Aug. 16, 2022

(54) AUTOMATED SYSTEM FOR THE INTEGRATION OF A LINER AND ENVELOPE

(71) Applicant: Create Technologies, Inc., Carson City, NV (US)

(72) Inventor: Nicholas P. De Luca, Carmel-by-the-Sea, CA (US)

(73) Assignee: Create Technologies, Inc., Carson City, NV (US)

( * ) Notice: Subject to any disclaimer, the term of this patent is extended or adjusted under 35 U.S.C. 154(b) by 26 days.

(21) Appl. No.: 16/732,019

(22) Filed: Dec. 31, 2019

(65) Prior Publication Data

US 2021/0122504 A1 Apr. 29, 2021

Related U.S. Application Data

(60) Provisional application No. 62/925,208, filed on Oct. 23, 2019.

(51) Int. Cl.

| | |
|---|---|
| ***B43M 3/04*** | (2006.01) |
| ***B65B 5/02*** | (2006.01) |
| ***B65B 5/04*** | (2006.01) |
| ***B65B 41/16*** | (2006.01) |
| ***B65B 51/02*** | (2006.01) |

(52) U.S. Cl.

CPC ..... *B65B 5/02* (2013.01); *B43M 3/045* (2013.01); *B65B 5/04* (2013.01); *B65B 41/16* (2013.01); *B65B 51/02* (2013.01)

(58) Field of Classification Search

CPC ..... B43M 3/045

USPC ..... 53/456, 466, 569, 574, 228

See application file for complete search history.

(56) References Cited

U.S. PATENT DOCUMENTS

| | | | | |
|---|---|---|---|---|
| 4,011,798 | A * | 3/1977 | Bambara | B29C 65/18 493/240 |
| 4,527,378 | A * | 7/1985 | Russell | B43M 3/00 493/245 |
| 4,653,248 | A * | 3/1987 | Bergner | B65B 11/42 53/231 |
| 4,669,253 | A * | 6/1987 | Shavit | B65B 43/10 493/929 |
| 4,853,071 | A * | 8/1989 | Romagnoli | B65B 11/40 53/134.2 |
| 4,880,651 | A * | 11/1989 | Christie | B65B 29/04 426/394 |

(Continued)

OTHER PUBLICATIONS

U.S. Appl. No. 16/237,568, filed Dec. 31, 2018.

*Primary Examiner* — Thanh K Truong
*Assistant Examiner* — Patrick B Fry
(74) *Attorney, Agent, or Firm* — Capitol City TechLaw; Jasbir Singh

(57) ABSTRACT

A system and method for continuously forming an envelope. The method includes providing a substrate including a liner, where the substrate has a side edge; plunging the substrate into a cartridge with a pusher to a desired depth to form a U having two opposing walls, two side openings and a flap opening; squeezing the two opposing walls along the two side openings, while keeping the flap opening open; sealing the two opposing walls along the two side openings to form the envelope; retracting the pusher; and filling the envelope disposed in the cartridge via the flap opening, where the substrate is disposed on a roll.

21 Claims, 15 Drawing Sheets

(56) References Cited

U.S. PATENT DOCUMENTS 4,885,896 A * 12/1989 Romagnoli ..... B65B 61/24 53/134.2
4,909,019 A * 3/1990 Delacretaz ..... B65B 11/42 53/463
5,454,642 A 10/1995 Luca
5,475,968 A * 12/1995 Linder ..... B65H 29/003 53/574
5,615,537 A * 4/1997 Vollenweider ..... B65B 25/14 53/429
5,651,237 A 7/1997 Luca
6,116,000 A 9/2000 Perkins et al.
6,141,944 A * 11/2000 Spatafora ..... B65B 19/225 53/579
6,659,150 B1 12/2003 Perkins et al.
6,883,294 B2 * 4/2005 Reist ..... B65B 5/022 53/450
6,932,751 B1 * 8/2005 Ward ..... B29C 66/8242 493/25
7,108,650 B2 * 9/2006 Marzano ..... B32B 7/04 156/257
7,621,104 B2 * 11/2009 Piucci ..... B31D 5/0073 53/403
8,402,725 B2 * 3/2013 Feijen ..... B43M 3/045 53/468
9,315,312 B2 4/2016 Luca et al.
2004/0250510 A1 * 12/2004 Dalietos ..... B65B 59/001 53/399
2010/0282824 A1 * 11/2010 Kannankeril ..... B65B 55/20 229/68.1
2011/0232229 A1 * 9/2011 Rea ..... B29C 66/849 53/167
2012/0260605 A1 * 10/2012 Nozawa ..... G03G 15/6594 53/55

* cited by examiner

AUTOMATED SYSTEM FOR THE INTEGRATION OF A LINER AND ENVELOPE

CROSS-REFERENCE TO RELATED APPLICATIONS AND INCORPORATION BY REFERENCE

The present application claims the benefit under 35 U.S.C. 119(e) of U.S. Provisional Application Ser. No. 62/925,208, filed Oct. 23, 2019, which is incorporated herein by reference in its entirety.

FIELD

The present disclosure teaches a manufacturing process for making an envelope with a liner such as that further described by De Luca et al. in U.S. Pat. No. 9,315,312 "Domed Multilayer Cushioning Article" as well as co-pending U.S. patent application Ser. No. 16/237,568 "Novel Manufacturing Process for Forming Domed Paper".

The system incorporating those elements already described in the co-pending application but further including means for forming an envelope within a cartridge. Said cartridge is temporarily integrated with the envelope, moved during the formation and sealing of the exterior edges except the top, activated so as to open the envelope, and dropped to a modifiable height and position for loading. Loading of the envelope is then further done manually or robotically, labeling adhered or printed, and the envelope is then sealed and ejected from the cartridge. Integration of the forming process with the electronic ordering system allowing for on-demand selection of various or multiple liners, weighing, and product selection.

The system can be used for the integration of various types of liners including those for shock protection, thermal protection, static protection, humidity and sunlight protection, and other active materials integrating RFID or blue tooth antennas.

BACKGROUND

Envelopes with liners are commonly used for the purpose of mailing and shipping packages that are relatively small or flat and require a small level of cushioning. In US patents U.S. Pat. Nos. 5,454,642 and 6,116,000 De Luca describes various methods for integrating air cushioning products with boxes or envelopes. In U.S. Pat. No. 9,315,312 "Domed Multilayer Cushioning Article" as well as co-pending patent application "Novel Manufacturing Process for Forming Domed Paper", De Luca describes a paper dome cushioning product that can be formed and integrated within an envelope.

The formation of padded mailer envelopes is commonly done both offsite and onsite of a warehouse distribution center or retail store. These mailers have padding formed within the sides of the envelopes that includes shredded paper, foam plastic, plastic bubble material, inflatable packaging, metal foil, and expanded foam packaging. One of the major disadvantages of producing these mailers offsite includes the cost of shipping them to the location of eventual use (ie. a fulfillment center) which generally becomes cost prohibitive past 200 miles from the manufacturing location. In order to enable distribution of cushioning products a greater distance from their location of manufacture, when possible, the packaging industry has developed equipment that provides the "bulking" of the material at the end customer site versus being done at the original manufacturing location. As an example, air packaging products use automated inflators to form wrap on site from compact rolls; for example U.S. Pat. No. 5,651,237A, 6659150B1, 6116000A describe such systems. With respect to paper products, companies such as Sealed Air Corporation, Ran-Pak Corp, StoroPak Inc., provide machines that mechanically crumple or cut paper to increase the volume—generally 30-80 times. U.S. Pat. No. 9,315,312 "Domed Multilayer Cushioning Article" and co-pending application "Novel Manufacturing Process for Forming Domed Paper" also describe the manufacturing process for a domed paper which can be formed on-site.

Current mailer systems use a fixed internal material that does not depend or is changed on the type of object shipped within the mailer. Thus, within a shipping facility, numerous types and sizes of mailers may have to be inventoried and thus requiring additional transport and logistics.

While recycling channels are more successful with the recycling of paper products versus plastic (approximately 70% versus 14% in 2015 according to the EPA) the ability to quickly seal by melting a plastic bag creates a significant advantage to paper.

When forming an envelope from materials that are paper based and recyclable, the use of gum tape adhesive is common. Gum tape adhesive though requires time to dry and the filling of an envelope with a wet adhesive can cause tearing.

Another issue with using paper envelopes versus plastic is that the inherent greater stiffness of the paper envelope makes it less pliable and harder to fill or to form around an object. The difficulty associated with forming an envelope around the object while also forming a paper envelop that is not deformed or damaged necessarily requires that the bag be manufactured separately. In manufacturing the envelope in a different process from the filling process though, inherently slows down the entire manufacturing and distribution cycle and minimizes the ability to integrate robotics or automation including steps for opening, holding, and labeling an envelope.

The ergonomic issues and problems associated with filling and sealing a bag can be significant for a packer. The worker must remove the bag from a stack, open the envelope, reach or bend to pick an object with another hand and then place the object within the bag. These movements can cause significant worker discomfort.

In the case of a robotic or automated process, the variability of object size can also create difficulties with envelopes that need to be opened and positioned by hand; especially in the case of shipping items that are diverse. This further complicates the ability to use paper based products for envelope mailers.

It is therefore a primary objective of the following invention to provide a consistent manufacturing process able to integrate a liner within an envelope that can be formed, sealed, filled with an object, and then sealed for shipment within a single machine.

It is further an object that the envelope be formable with paper and the liner be formable made with domes per U.S. Pat. No. 9,315,312.

It is a further objective of the current invention that the continuous manufacturing process allow for the consistent alignment and formation of the envelope sides.

It is also an object of the current invention that the curing of the adhesive used to adhere the envelope sides be accomplished without requiring additional handling of the envelope prior to filling.

It is another object of the current invention that the position of the envelope while loading with an object be easily adjustable.

It is further an object of the current invention that the manufacturing system allow for various sizes and liners to be integrated within the envelope formed.

It is another objective of the current invention that the manufacturing process be usable within a packaging warehouse distribution center.

It is another objective of the current invention that formation of the envelope within the manufacturing system can be easily integrated with the computer ordering system and can appropriately label and weigh the envelope as processed.

SUMMARY

The present teachings provide embodiments of a novel automated manufacturing process for continuously forming envelopes integrated with a liner. The liner formed on demand from compact rolls of raw material such as that further described per U.S. Pat. No. 9,315,312 and co-pending patent application "Novel Manufacturing Process for Forming Domed Paper" and integrated within the machine simultaneously as the envelope sides are formed within a containing cartridge and selective activation of the liner adhesive such that the closure flap is not sealed. Once lined, the cartridge is moved within the machine to the loading area such that the sides of the envelope can be formed and the envelope forced open within the cartridge, including through automatic means involving shortening of the cartridge opening. The cartridge then positioned to the location most suitable for loading with a vertical adjustment capability to accommodate workers or a robotic loader. After loading, the envelope opening is sealed by folding the flap and in the case of a paper liner, the flap can be moistened and pressed within the cartridge. Labeling and weighing station as well as quality control systems can be integrated into the cartridge and holder. Once dry, the filled envelope can be ejected from the cartridge onto a conveyor belt for shipment; the cartridge then returning for refilling.

In one embodiment multiple liner materials can be selected, combined, and integrated with various envelope materials; a liner may also be omitted from the formed envelope. Selection of the liner can be made automatically or in correlation to the product to be packaged with the envelope. Factors such as the size, fragility, thermal sensitivity, static sensitivity, shock protection.

A method for continuously forming an envelope. The method includes providing a substrate including a liner, where the substrate has a side edge; plunging the substrate into a cartridge with a pusher to a desired depth to form a U having two opposing walls, two side openings and a flap opening; squeezing the two opposing walls along the two side openings, while keeping the flap opening open; sealing the two opposing walls along the two side openings to form the envelope; retracting the pusher; and filling the envelope disposed in the cartridge via the flap opening, where the substrate is disposed on a roll.

Implementations may include one or more of the following features. The method where the liner is disposed on a second roll different than the roll. The squeezing is performed by rollers disposed to contact the substrate adjacent to the two side openings. The sealing may include heating the substrate adjacent to the two side openings. The sealing further may include closing and affixing the flap. The liner may include a domed paper material disposed on a second roll. The sealing may include activating a gum tape adhesive. The substrate may include a meltable plastic and the sealing may include heating the substrate adjacent to the two side openings. The method may include selecting the liner based on a content to be disposed in the envelope. The liner may include an inflatable liner. The sealing seals the flap opening. The method may include moving the envelope and the cartridge to permit horizontal access to the flap opening by the operator.

One general aspect includes a machine system to continuously form an envelope. The machine system includes a substrate including a liner, where the substrate has a side edge; a cartridge; a pusher to plunge the substrate into the cartridge to a desired depth to form a U having two opposing walls, two side openings and a flap opening; holders to squeeze the two opposing walls along the two side openings, while keeping the flap opening open; and a sealer to seal the two opposing walls along the two side openings to form the envelope, where the pusher is retracted, the envelope disposed in the cartridge is filled via the flap opening and the substrate is disposed on a roll.

It is to be understood that both the foregoing general description and the following detailed description are exemplary and explanatory and are intended to provide further explanation of the invention as claimed.

BRIEF DESCRIPTION OF THE FIGURES

The accompanying drawings, which are included to provide a further understanding of the invention and are incorporated in and constitute a part of this specification, illustrate embodiments of the invention, and together with the description serve to explain the principles of the invention.

Figure 1:
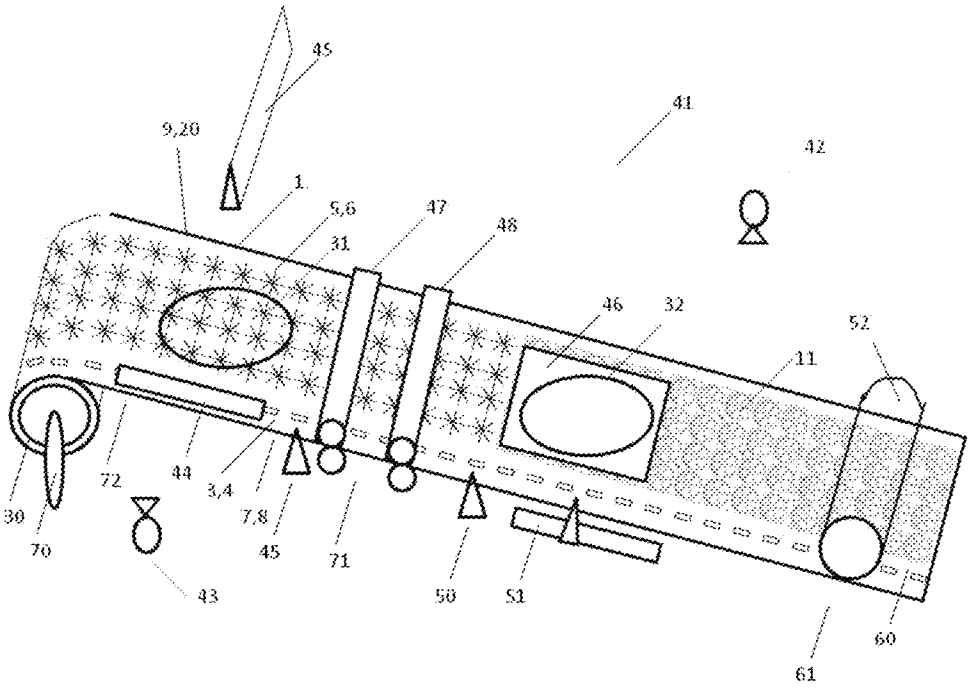
FIG 1 (PRIOR ART)
FIG. 1 is a drawing from co-pending patent application "Novel Manufacturing Process for Forming Domed Paper", an isometric view indicating key areas required in a machine system to form the domes for a liner.

Throughout the drawings and the detailed description, unless otherwise described, the same drawing reference numerals will be understood to refer to the same elements, features, and structures. The relative size and depiction of these elements may be exaggerated for clarity, illustration, and convenience.

DESCRIPTION

The present teachings disclose a novel process for manufacturing an envelope with a liner and integrating an item to be packaged.

Figure 2:
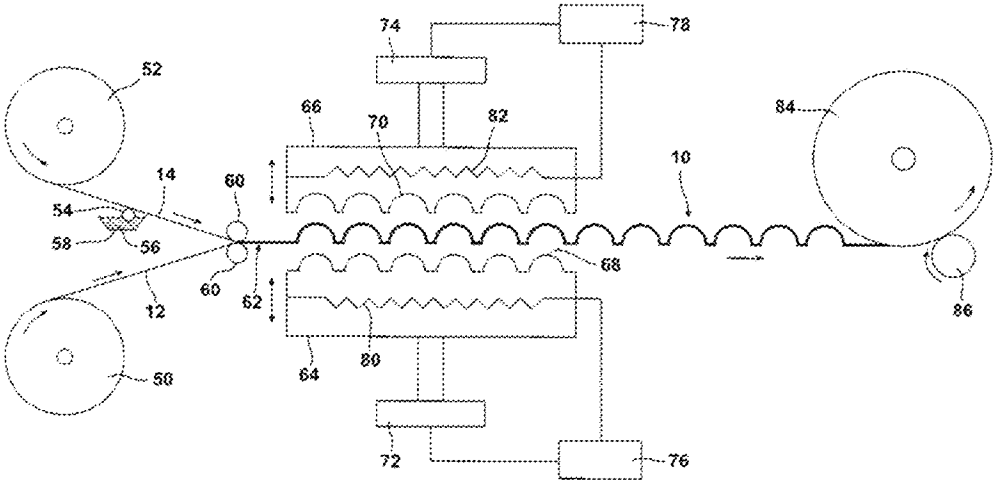
FIG 2 (PRIOR ART)
FIG. 2 is a drawing from U.S. Pat. No. 9,315,312 showing a continuous process for forming domed paper for further use in packaging or integrated box or envelope products.
Figure 3:
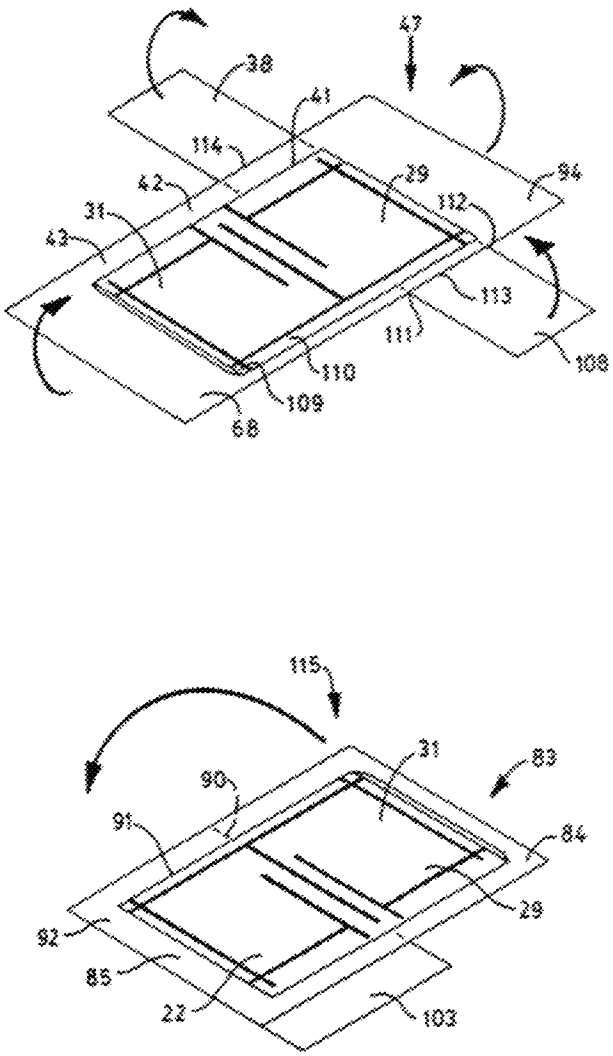
FIG 3 (PRIOR ART)
FIG. 3 is a drawing from U.S. Pat. No. 5,454,642 showing the integration of an inflatable package with a liner.

FIG. 1 is a drawing from co-pending patent application "Novel Manufacturing Process for Forming Domed Paper", an isometric view indicating key areas required in a machine system to form the domes for a liner. FIG. 2 is a drawing from U.S. Pat. No. 9,315,312 showing a continuous process for forming domed paper for further use in packaging or integrated box or envelope products. FIG. 3 is a drawing from U.S. Pat. No. 5,454,642 showing the integration of an inflatable package with a liner. These figures help to illustrate the existing prior art associated with forming envelopes with liners, how these liners have included such diverse materials as inflatable bladders, and the process associated with forming a paper dome material.

Figure 4A:
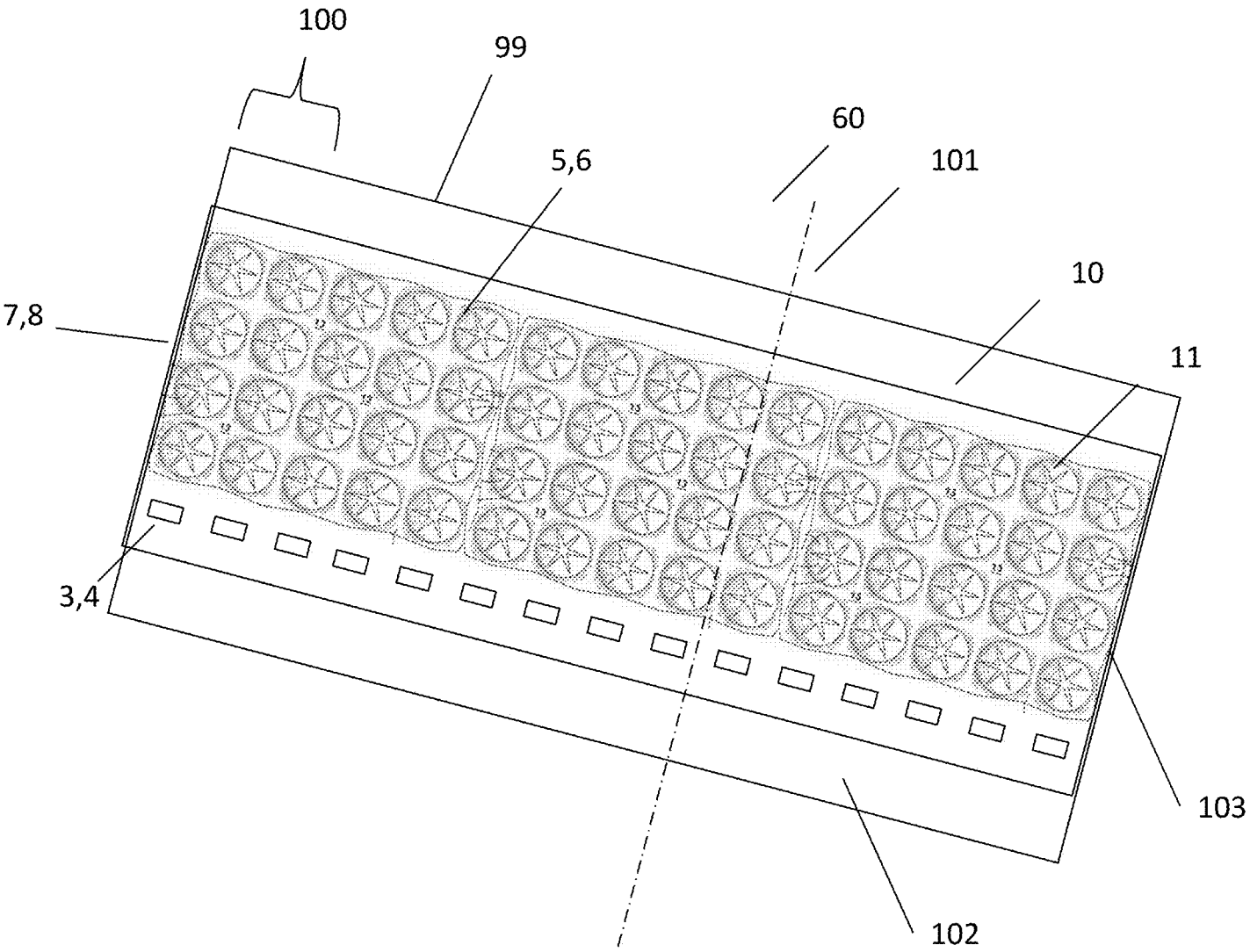
FIG 4a (PRIOR ART)
FIG. 4*a* is an isometric view showing the integration of a domed paper liner to form an envelope.
Figure 4B:
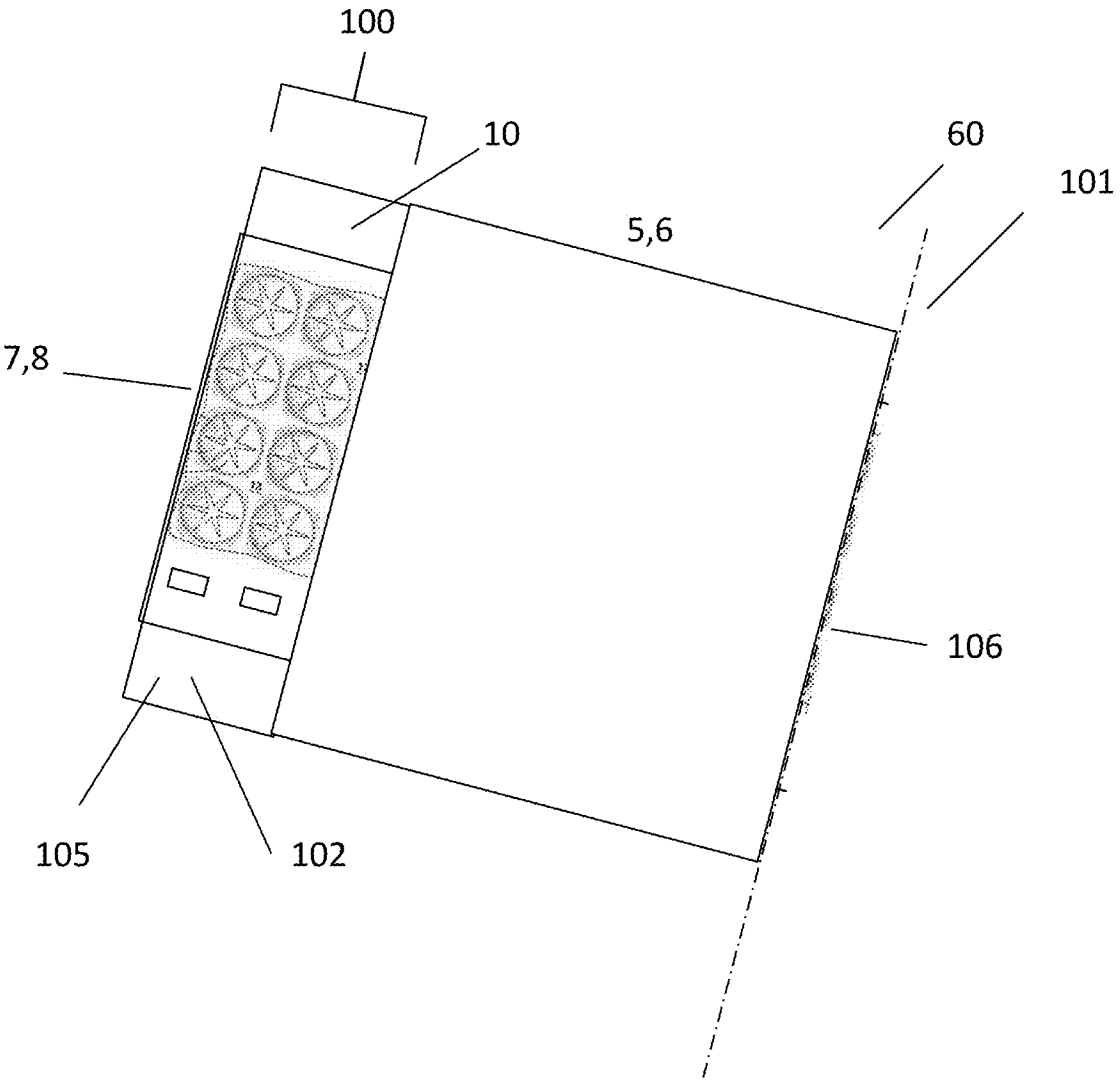
FIG 4b (PRIOR ART)
FIG. 4*b* in an isometric view of the liner in FIG. 4*a* once folded to form an envelope with sealed sides.
Figure 4C:
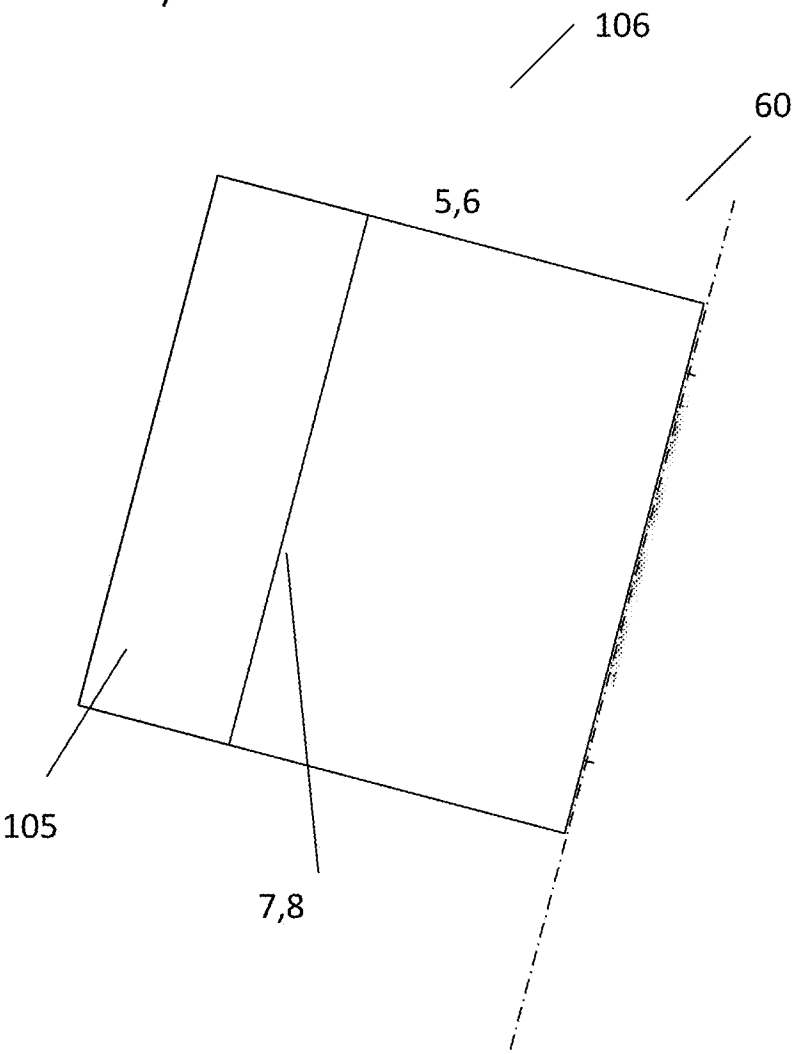
FIG 4c (PRIOR ART)
FIG. 4*c* is an isometric view of the liner of FIGS. 4*a* and 4*b* with the top flap closed.

A common way to form an envelope is shown in FIGS. 4*a*, 4*b*, and 4*c*. In FIG. 4*a* an isometric view of the substrate 60 formed from a domed paper liner 11 (formed from sheets 5 and 6 with registration marks 3 and 4) selectively adhered to the envelope exterior 99 which may be a 40 pound kraft paper with a gum tape adhesive to eventually form envelop 106. Side areas 10 and 102 of the layer 11 will normally have adhesive and in the case of water activated gum tape will be moistened prior to folding about folding line 101. Area 100 under the liner 5,6 is left without adhesive or without being activated such that the liner can be separated from the back layer to form a sealable flap at edge 7 and 8 of materials 11 and 99 respectively. Edge 103 may also be partially non-adhered between the liner 11 and envelope exterior 99 as it forms the adjacent seem to the next liner and edges 7 and 8. In FIG. 4*b* the unit 1 is folded at line 101 to form edge 106 and the adhesive of side areas 10 and 11 activated so as to form the pouch and flap 105. In FIG. 4*c*, the liner 11 is folded into the envelope while the exterior flap 105 is moistened and secured to the surface of layer 99. In some cases, the liner 11 may be shortened so as to avoid having to insert it into the formed lined envelope 106.

Figure 5:
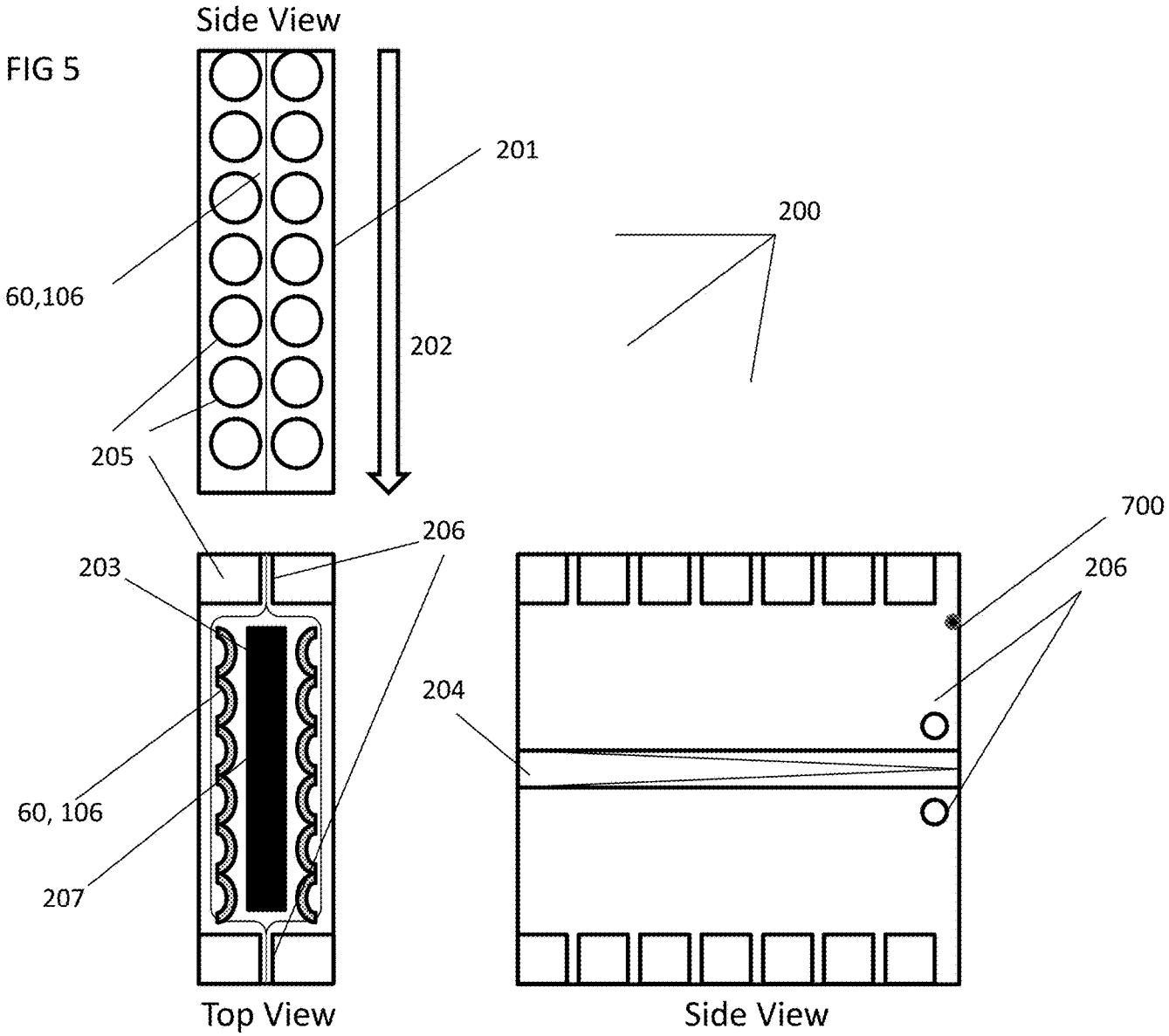
FIG. 5 is a flat three view drawing of the container used to form, seal, fill, and close the envelope per the current invention.

FIG. 5 is a flat three view drawing of the cartridge 200 used to form, seal, fill, and close the envelope 106 per the current invention within the walls 201 of the cartridge. Substrate 60 incorporating a liner 11 is pushed downward into cartridge 200 in direction 202 using plunger 207. As the liner moves downward into the cartridge the edges 10 and 102 are pressed between rollers 205 which may be heated or used to activate the adhesive between the sheet 99. Once formed into the open envelope 106, the walls of cartridge 200 closes the gap 204 in the case 201 with mechanical, electromechanical, electric, or pneumatic means such that the envelope opens but remains held by the side rollers or holders 205. The cartridge 200 may also be fitted with sensors 700 such as a weight sensor or may have openings for applying a label directly to the envelope exterior. The case 201 may also have gearing components or holders that allow it to be moved and transported within a machine system as well as heaters or dryers to help cure or seal the envelope. A closure mechanism for the flap 105 can also be included in the cartridge as well as a mechanism to release the liner once formed.

Figure 6A:
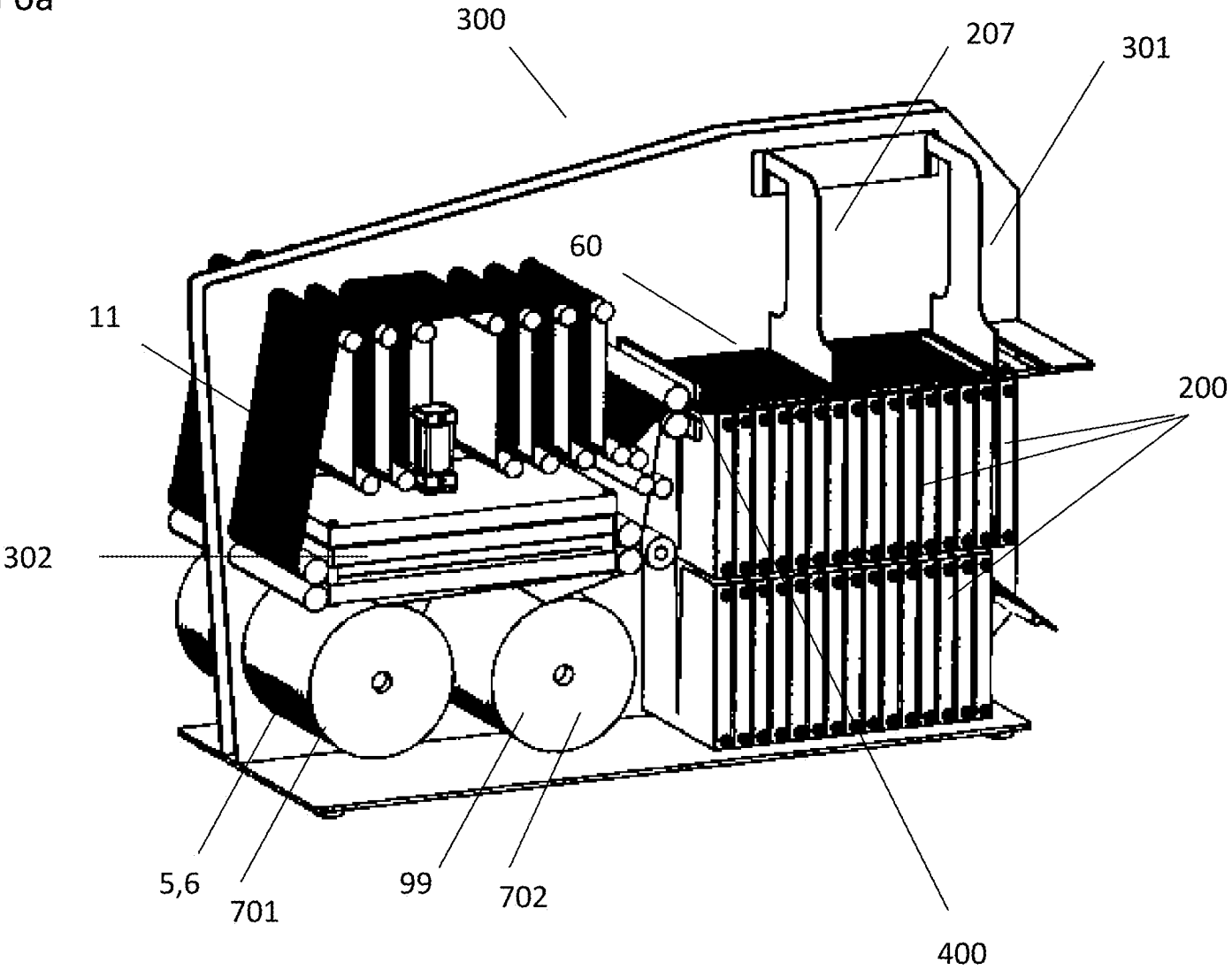
FIGS. 6*a*, 6*b*, and 6*c* are isometric drawings of the machine system used to form the liner and envelope combination.
Figure 6B:
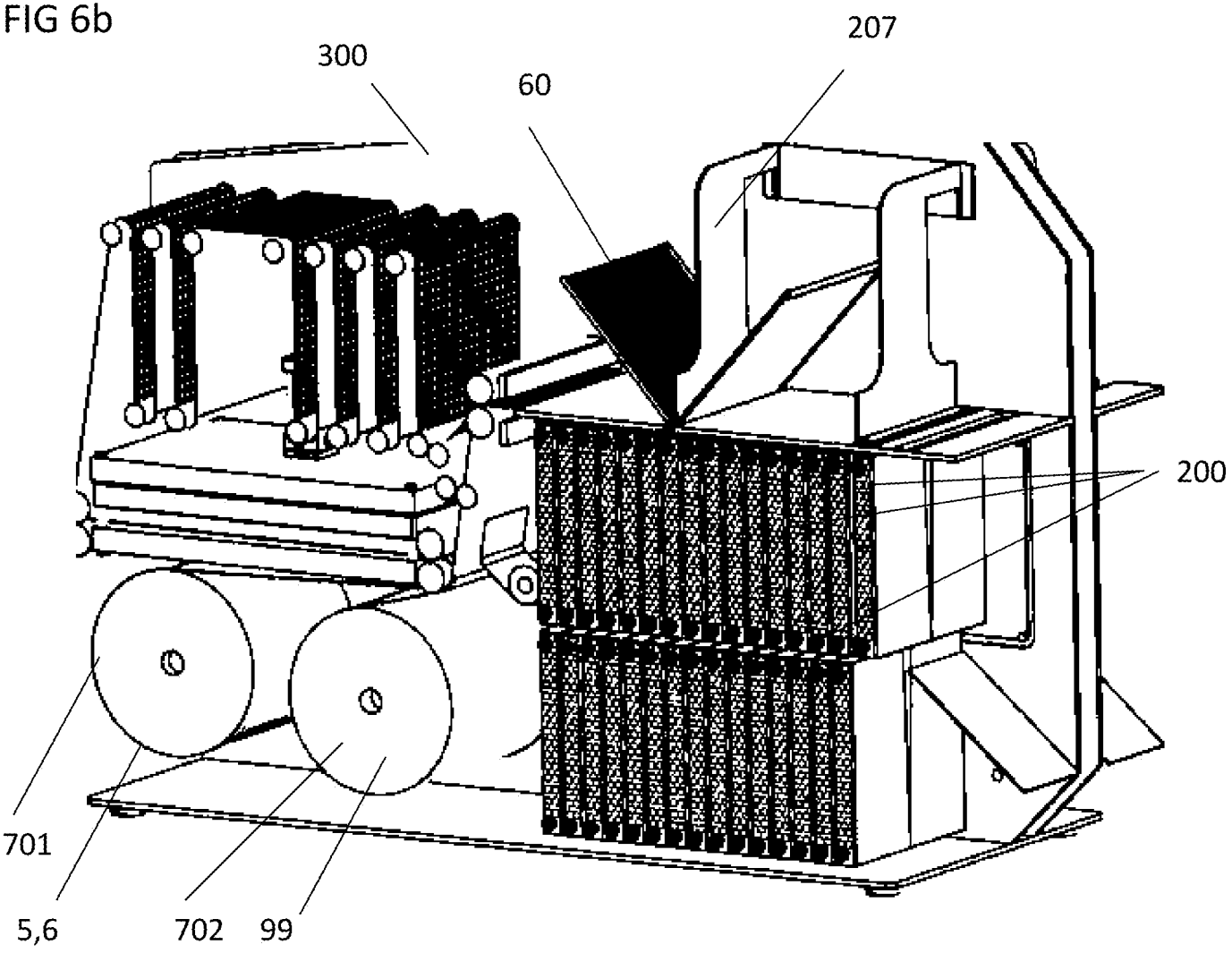
Figure 6C:
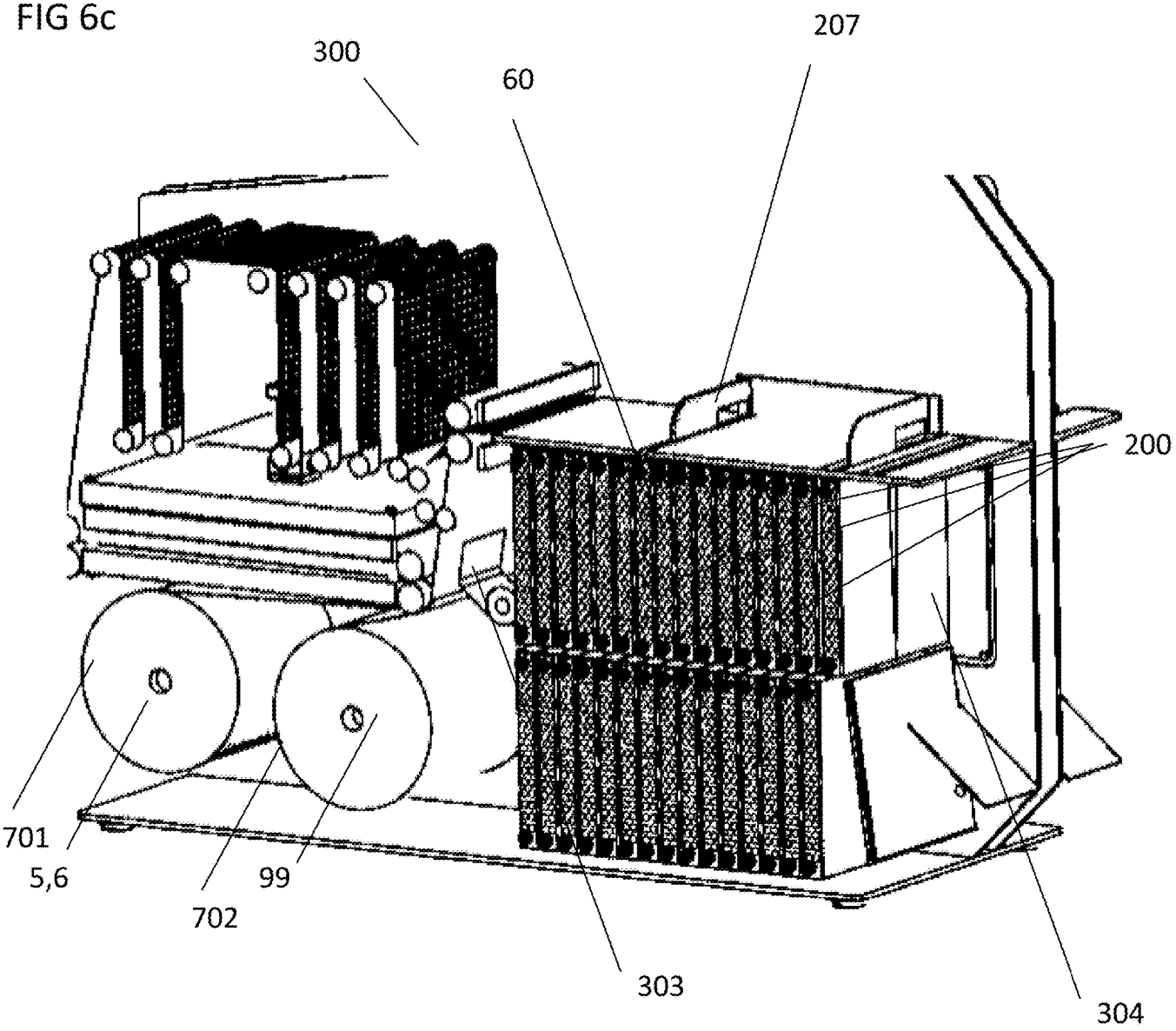

FIG. 6*a* in an isometric view of machine system 300 used to form substrate 60 and envelope 106 from liner 11 and exterior layer 99. In this configuration, liner 11 is formed in press 302 from a roll 701 having two layers 5 and 6 used to form the paper dome liner. In some cases roll 11 may already be formed and in some cases more than one roll containing more than one liner material may be used and combined with envelope exterior 99 also on a roll 702. Once combined, cut knife 400 cuts the correct length of the substrate 60 and pushes it into cartridge 200 using pusher 207 as further shown in FIG. 6*b*. In some cases no liner is used and only the exterior 99 is used to form the envelope. Connection to the ordering and product systems may be used to manufacture the correctly lined envelope based on the items to be packed and label. For example, liners requiring additional shock protection may be used or thermal protection including foil. In addition, liners may be adhered or left without adhesive so that they can be removed after use. A label 303 may be used to label the envelope exterior 99 prior to or after it is inside the cartridge such as through face 304 of the cartridge 200.

Figure 7:
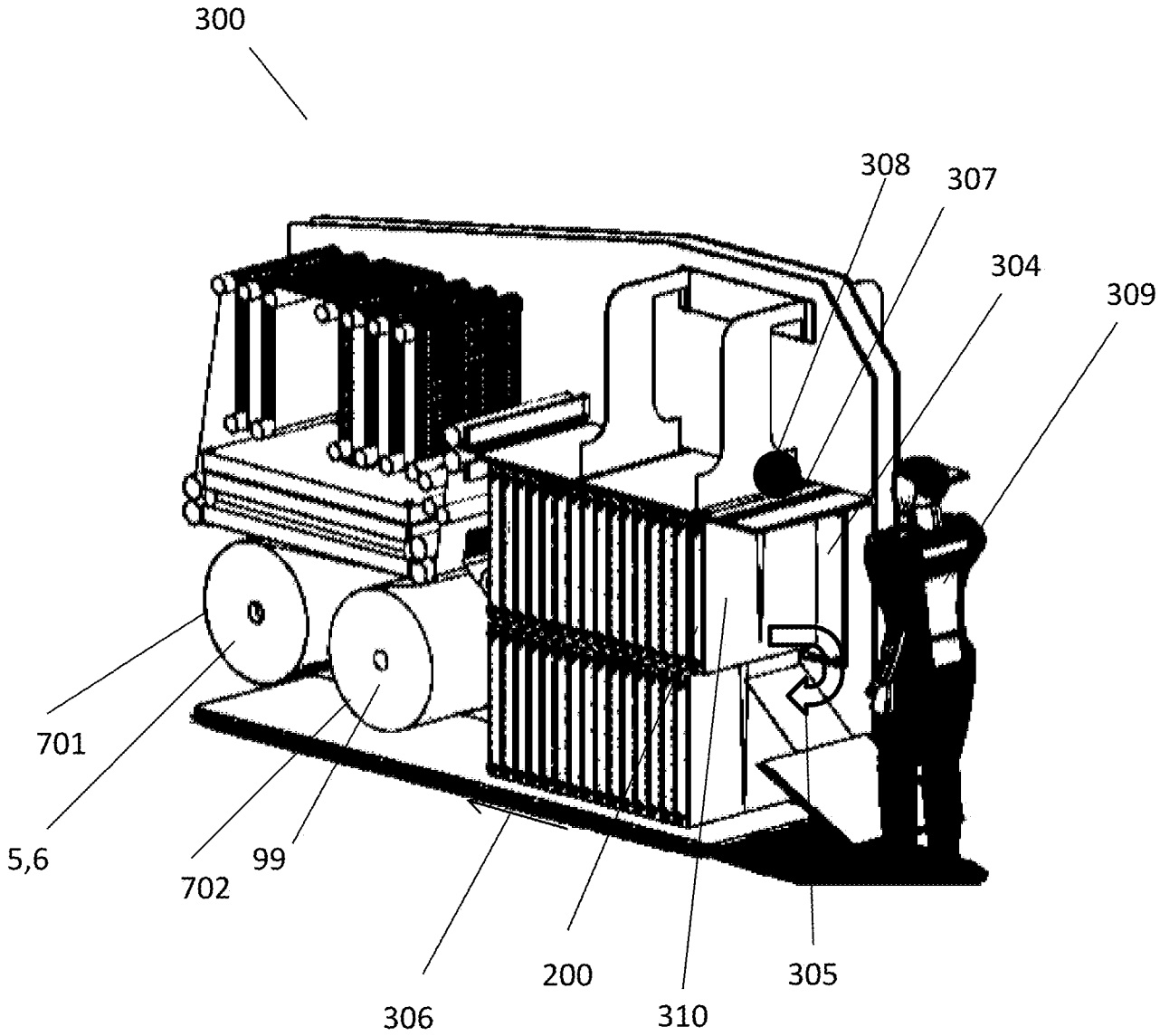
FIG. 7 is an isometric drawing showing a machine system used to form the liner and envelope combination and the filling of the formed envelope with an object using cartridges placed for a fixed vertical insertion position.

As shown in FIG. 7, cartridge and envelope assembly 310 is moved towards individual 309 so that object 308 can be placed into opening 307 of envelope 106. The cartridge sides move inwards so as to open the envelope 106 to allow for ease of placement of the object. Once filled with object 308, the envelope top flap 105 is sealed within the cartridge. Sealing can be accomplished with a roller or other mechanical pressing and activated with a moistener applied to flap 105. If using a plastic liner, a heat seal could also be employed to for the seal. The closure of cartridge 200 can also active the top flap 105 seal closure process, and in some cases, the filled envelope can be removed from the cartridge and sealed separately. A robotic system may also be employed along side or in replacement of manual labor 309 for the product placement within the envelope. Once top flap 105 is sealed within the cartridge, the cartridge moves in direction 305 and 306 so that ample time is allowed for the flap to securely adhere prior to the envelope being ejected.

Figure 8:
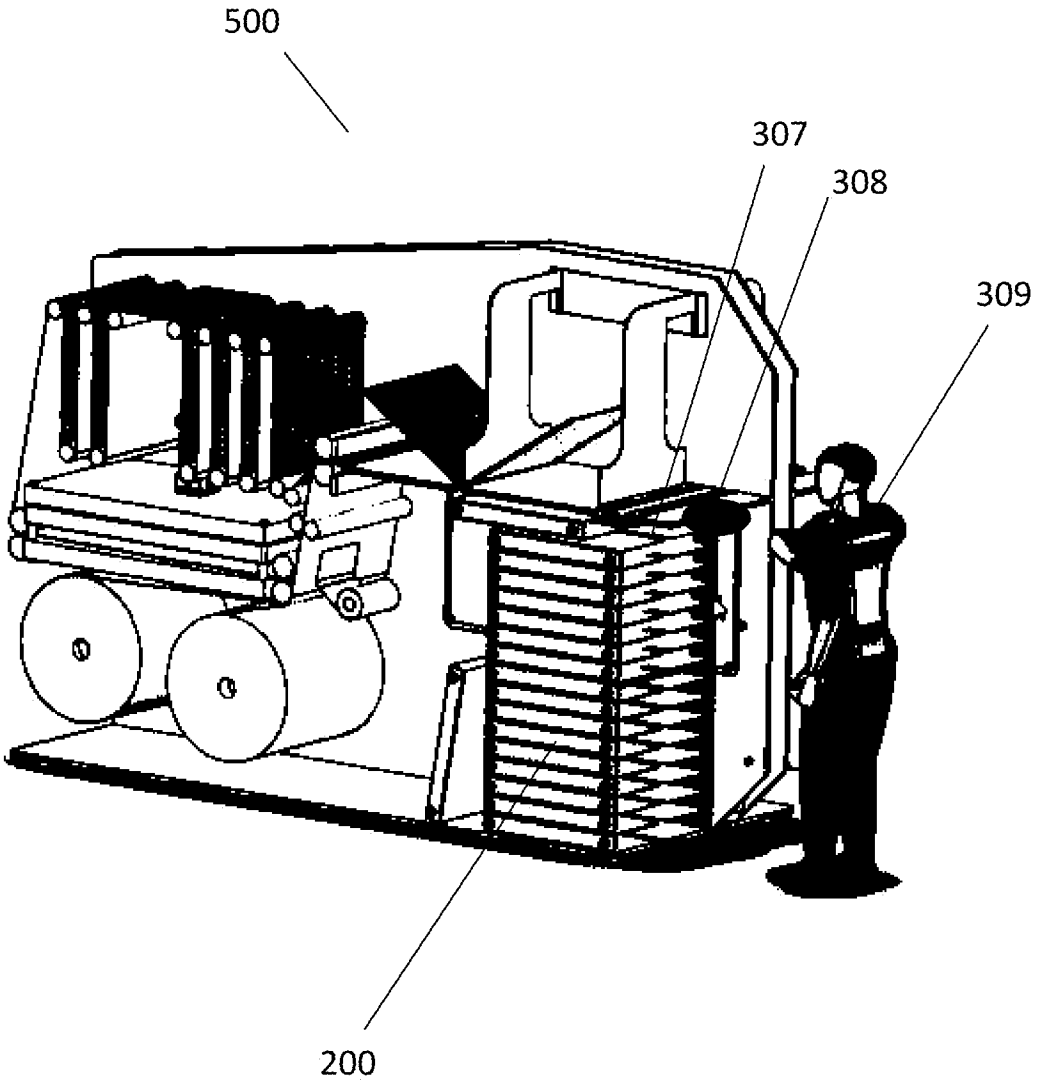
FIG. 8 is an isometric drawing showing a machine system used to form the liner and envelope combination and the filling of the formed envelope with an object using cartridges placed for a fixed horizontal or tilted insertion position.

FIG. 8 is an alternate machine system 500 wherein the cartridges 200 are stacked so that their openings 307 are oriented such that worker 309 can place object 308 in a horizontal orientation.

Figure 9:
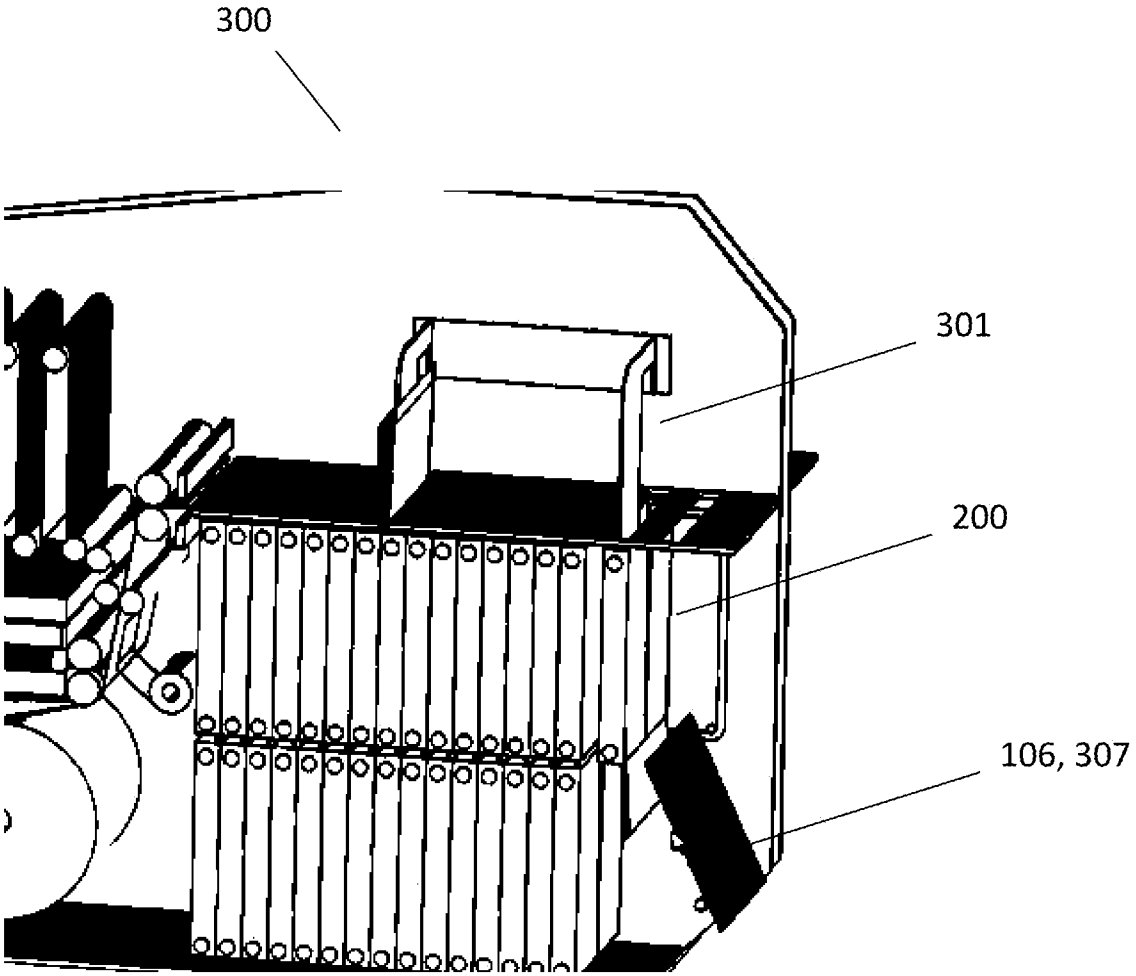
FIG. 9 is an isometric drawing showing the ejection of a filled and sealed lined envelope from a machine system used to form the liner and envelope combination.

FIG. 9 shows the ejection of the filled envelope 106 and final package 307 from the cartridge 200 using plunger 301. Package 307 may be ejected onto a conveyor belt 311 (as shown in FIG. 10) or into a hopper, tray, or a secondary container or box.

Figure 10:
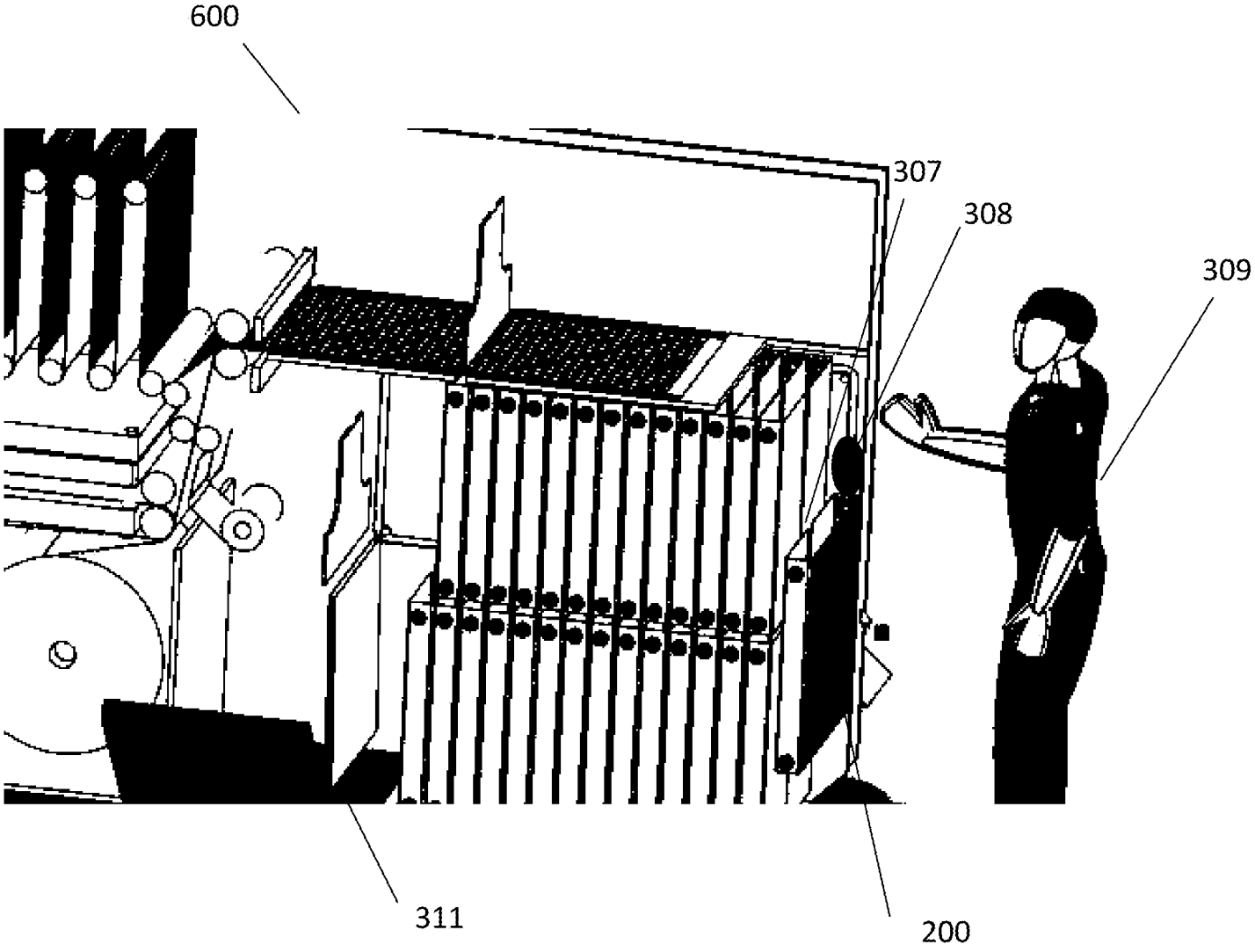
FIG. 10 is an isometric drawing showing a machine system used to form the liner and envelope combination and the filling of the formed envelope with an object using cartridges placed for a variable fixed horizontal or insertion position.

FIG. 10 shows machine 600 in which the vertical placement of cartridge 200 adjustable and can be stopped correctly to minimize the strain on a worker or to facilitate automatic placement of object 308 within the envelope.

Figure 11:
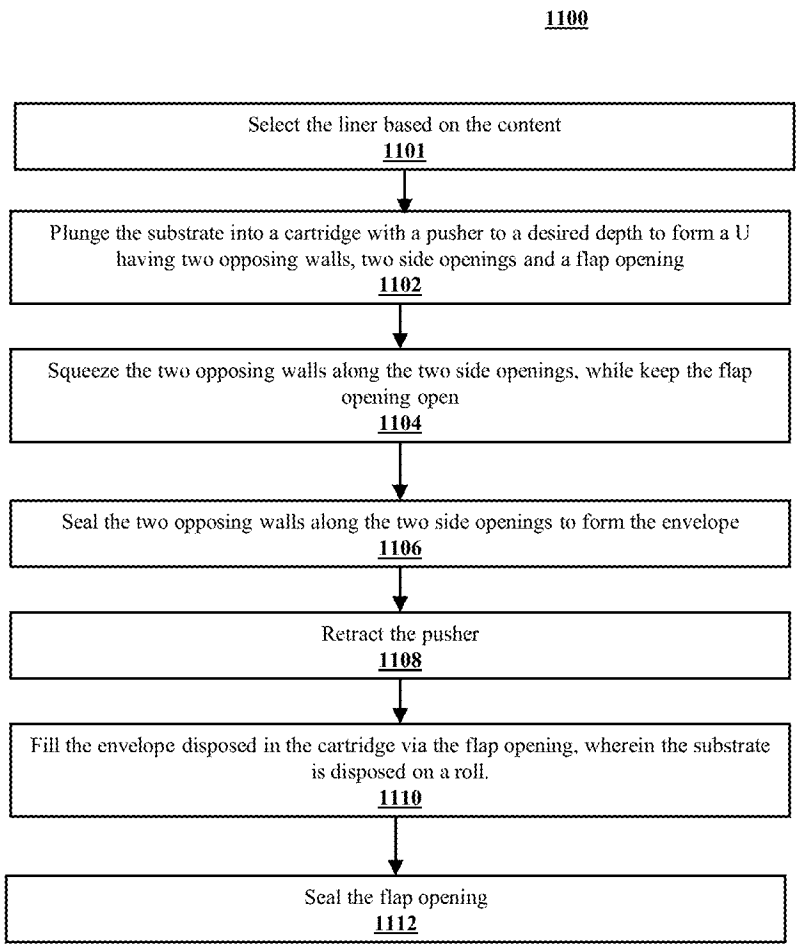
FIG. 11 illustrates a method to form an envelope.

FIG. 11 illustrates a method for forming an envelope according to various embodiments.

A method 1100 for forming an envelope may include operation 1101 to select a liner. The method 1100 may further include operation 1102 to plunge the substrate into a cartridge with a pusher to a desired depth to form a U having two opposing walls, two side openings and a flap opening. The method 1100 may further include operation 1104 to squeeze the two opposing walls along the two side openings, while keeping the flap opening open. The method 1100 may further include operation 1106 to seal the two opposing walls along the two side openings to form the envelope. The method 1100 may further include operation 1108 to retract the pusher. The method 1100 may further include operation 1110 to fill the envelope disposed in the cartridge via the flap opening. The method 1100 may further include operation 1112 to seal the flap opening.

The examples presented herein are intended to illustrate potential and specific implementations. It can be appreciated that the examples are intended primarily for purposes of illustration for those skilled in the art. The diagrams depicted herein are provided by way of example. There can be variations to these diagrams or the operations described herein without departing from the spirit of the invention. For instance, in certain cases, method steps or operations can be performed in differing order, or operations can be added, deleted or modified.

What is claimed is:

1. A method for continuously forming an envelope, the method comprising:

providing a substrate comprising a liner, wherein the substrate has a side edge;

plunging the substrate into a cartridge with a pusher to a desired depth to form a U having two opposing walls, two side openings and a flap opening;

squeezing the two opposing walls along the two side openings, while keeping the flap opening open;

sealing the two opposing walls along the two side openings to form the envelope;

retracting, after the sealing, the pusher; and filling the envelope disposed in the cartridge via the flap opening, wherein the substrate is disposed on a roll.

2. The method of claim 1, wherein the liner is disposed on a second roll different than the roll.

3. The method of claim 1, wherein the squeezing is performed by rollers disposed to contact the substrate adjacent to the two side openings.

4. The method of claim 1, wherein the sealing comprises heating the substrate adjacent to the two side openings.

5. The method of claim 1, wherein the sealing further comprises closing and affixing the flap.

6. The method of claim 1, wherein the liner comprises a domed paper material disposed on a second roll.

7. The method of claim 1, wherein the liner comprises a gum tape adhesive along an edge of the liner and the sealing comprises activating the gum tape adhesive.

8. The method of claim 1, wherein the substrate comprises a meltable plastic and the sealing comprises heating the substrate adjacent to the two side openings.

9. The method of claim 1, further comprising selecting the liner based on a content to be disposed in the envelope.

10. The method of claim 1, wherein the liner comprises an inflatable liner.

11. The method of claim 1, further comprising disposing the flap opening for access by an operator; and filling the envelope with a content, wherein the sealing seals the flap opening.

12. The method of claim 11, further comprising moving the envelope and the cartridge to permit horizontal access to the flap opening by the operator.

13. The method of claim 1, further comprising engaging the pusher with a content to be disposed in the envelope in the cartridge; filling the content in the envelope in the cartridge with the pusher; and releasing the content in the envelope in the cartridge.

14. The method of claim 13, wherein the filling and the plunging are performed simultaneously.

15. A machine system to continuously form an envelope, the machine system comprising:

a substrate comprising a liner, wherein the substrate has a side edge;

a cartridge;

a pusher to plunge the substrate into the cartridge to a desired depth to form a U having two opposing walls, two side openings and a flap opening;

holders to squeeze the two opposing walls along the two side openings, while keeping the flap opening open; and a sealer to seal the two opposing walls along the two side openings to form the envelope, where the pusher is retracted, the envelope disposed in the cartridge is filled via the flap opening after the two opposing walls have been sealed by the sealer, and the substrate is disposed on a roll.

16. The machine system of claim 13, wherein the liner is disposed on a second roll different than the roll.

17. The machine system of claim 13, further comprising a heater to heat and seal the substrate adjacent to the two side openings.

18. The machine system of claim 13, wherein the liner comprises a domed paper material disposed on a second roll.

19. The machine system of claim 13, further comprising a moistener and a roller, wherein the moistener moistens an adhesive on a flap prior to the roller closing the flap.

20. The machine system of claim 13, further comprising an order and product system to select the liner based on a content to be disposed in the envelope.

21. The machine system of claim 13, wherein the liner comprises an inflatable liner.

* * * * *